United States Patent [19]

Horne

[11] Patent Number: 5,024,353

[45] Date of Patent: Jun. 18, 1991

[54] DISPENSER FOR REFRIGERATED LIQUIDS

[76] Inventor: David M. Horne, 4472 Garwood Dr., Ladson, S.C. 29456

[21] Appl. No.: 448,339

[22] Filed: Dec. 11, 1989

[51] Int. Cl.[5] ..... B67D 3/00

[52] U.S. Cl. ..... 222/185; 222/481.5; 222/505; 248/311.3

[58] Field of Search ..... 222/484, 481.5, 185, 222/181, 505, 514; 248/134, 147, 311.3; 137/595, 597; 251/263

[56] References Cited

U.S. PATENT DOCUMENTS

| | | | |
|---|---|---|---|
| 3,814,293 | 6/1974 | Daves | 222/173 |
| 4,664,297 | 5/1987 | Giovinazzi | 222/185 |
| 4,667,856 | 5/1987 | Nelson | 222/180 |
| 4,715,516 | 12/1987 | Salvail | 222/153 |
| 4,722,463 | 2/1988 | Anderson | 222/185 |
| 4,844,290 | 7/1989 | McCurdy et al. | 222/185 |
| 4,911,334 | 3/1990 | Kedzierski | 222/185 |

*Primary Examiner*—Michael S. Huppert
*Assistant Examiner*—Anthoula Pomrening

[57] ABSTRACT

A dispenser mechanism attachable to a plastic soft drink bottle to permit measured liquid quantities to be dispensed from the bottle. A cradle type support is provided for positioning the bottle in an inverted tilted condition within a refrigerator. Liquid can be dispensed from the bottle without removing the bottle from the refrigerator.

4 Claims, 1 Drawing Sheet

DISPENSER FOR REFRIGERATED LIQUIDS

BACKGROUND AND SUMMARY OF THE INVENTION

This invention relates to a dispenser for a liquid beverage, e.g. soft drinks sold under such tradenames as Coca Cola and Pepsi Cola.

Commonly, soft drinks are marketed in various sized cans and bottles, e.g. twelve ounce cans, two liter plastic bottles, and three liter plastic bottles. The present invention concerns a dispenser assembly that includes a valve mechanism screwable onto the externally threaded neck of a plastic soft drink bottle (two liter size or three liter size). The dispenser assembly further includes a cradle adapted for positionment on the shelf of a standard household refrigerator to removably support the plastic bottle in a tilted inverted condition. With the bottle thus supported, the valve mechanism will be located near the front edge of the refrigerator shelf where it can be manually operated to dispense a liquid beverage from the plastic bottle into a glass or cup held beneath the discharge spout of the valve mechanism.

The dispenser assembly is a convenience item that enables persons in the household to fill their glasses with a soft drink without having to remove the soft drink bottle from the refrigerator. The filling operation can be performed quickly, and with a lessened possibility for spillage of the soft drink, due to the inadvertent dropping of the bottle onto the kitchen floor. The bottle remains within the refrigerator, thereby avoiding the possibility that the beverage within the bottle will assume room temperature due to failure of the person to return the bottle to the refrigerator after the individual glass has been filled.

THE DRAWINGS

FIG. 1 shows the mechanism operatively supporting a conventional beverage container.

DESCRIPTION OF A PREFERRED EMBODIMENT OF THE INVENTION

Figure 1:
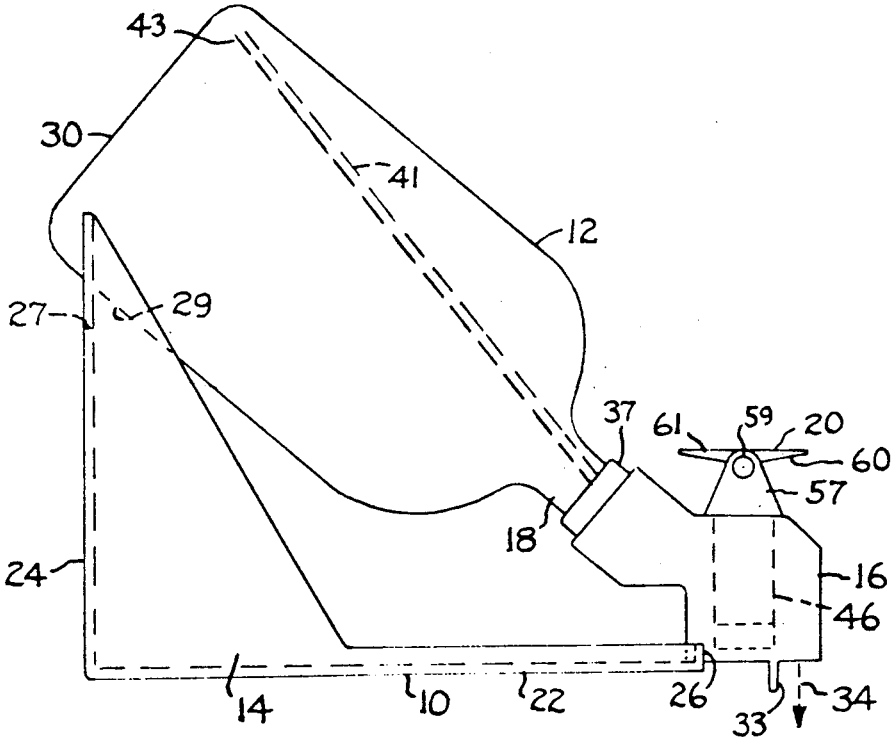
FIG. 1 is a side elevational view of a dispenser mechanism embodying the invention.

FIG. 1 shows a dispenser mechanism 10 for dispensing a soft drink or other liquid beverage from a plastic container 12; the preferred container is a two (or three) liter plastic bottle containing a soft drink. The dispenser mechanism includes a cradle 14 adapted to rest on the shelf of a household refrigerator, and a valve housing 16 adapted to be screwed onto the neck area 18 of container 12. Valve housing 16 has an interlocking fit on the front portion of cradle 14, such that bottle (container) 12 is retained in a tilted inverted condition, as shown in FIG. 1. A handle operator 20 is provided for the valve mechanism within housing 16, so that a person can fill his glass with the liquid beverage without disturbing bottle 12; the bottle remains in the FIG. 1 position during the beverage dispensing operation.

Cradle 14 comprises a flat base plate 22, an upstanding rear wall 24, and an upstanding front wall 26. Wall 24 has a V-shaped notch 27 in its upper edge to supportably engage the side surface 29 of plastic container 12 near the inverted container bottom wall 30. The V-shaped notch prevents the cylindrical bottle from rolling in a transverse direction.

Cradle front wall 26 is adapted to fit into an external groove 31 in valve housing 16 to prevent the container-valve assembly 12, 16 from sliding off the cradle in a forward (rightward) direction. Cradle walls 24 and 26 cooperatively support container 12 in an inverted, tilted condition, as shown in FIG. 1. The container and attached valve housing 16 can be removed from cradle 14, e.g. when the container is empty and requires replacement with a full container. The cradle is designed for placement on a refrigerator shelf so that its front wall 16 is just behind the shelf front edge. A depending flange (lip) 33 on valve housing 16 can be engaged with the shelf front edge, such that the liquid discharge opening in housing 16 is located just forwardly from the shelf; the liquid is discharged downwardly generally along imaginary line 34. A glass or cup can be positioned against the front face of lip 33 to receive the discharged liquid.

Figure 2:
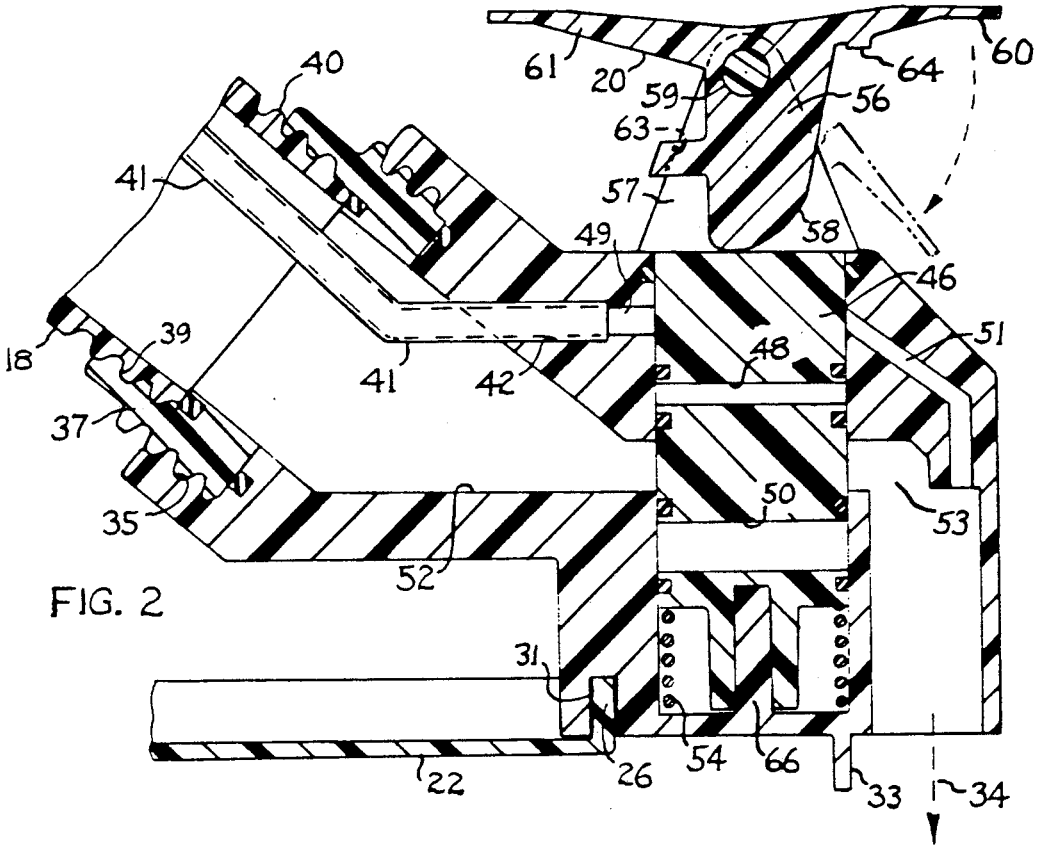
FIG. 2 is an enlarged sectional view of a valve unit forming part of the FIG. 1 mechanism.

FIG. 2 illustrates some details of the valve mechanism that controls the flow of liquid from the inverted tilted container. Valve housing 16 has an internal (female) screw thread 35 screwable onto a threaded section of a tubular adapter 37. The adapter has an internal thread 39 sized to thread onto the threaded area 40 of container neck 18. The function of adapter 37 is to provide a transitional connector between valve housing 16 and a two liter plastic bottle 12. When valve housing 16 is to be attached to a three liter plastic bottle, adapter 37 is removed; housing 16 is then screwed directly on the neck area of the three liter bottle. Adapter 37 forms a removable part of valve housing 16.

An elongated plastic tube 41 has a press fit in a bore 42 within housing 16. Tube 41 extends out of valve housing 16 through the neck 18 of bottle 12. As shown in FIG. 1, the upper (free) end 43 of the tube is located near the bottom wall of the inverted bottle. Tube 41 acts as an air supply means to introduce air into bottle 12 during the period when liquid is being discharged from the bottle. Introduction of air into the bottle prevents the formation of a vacuum, and thus contributes to full (rapid) liquid flow from the bottle. A tube extension may be attached to the upper free end of tube 41 when the valve mechanism is to be used with the larger three liter bottle.

A plug valve element 46 is slidably supported in a cylindrical bore (socket) in valve housing 16. The plug element can slide vertically without rotating. Two horizontal holes 48 and 50 extend transversely through the plug element. In the illustrated position of the plug element the transverse holes are closed (inactive). Upward movement of the plug element causes holes 48 and 50 to register respectively with an air passage system and a liquid passage system extending through the valve housing.

The air passage systems includes a short air passage 49 communicating with the left face of plug element 46, and a longer air passage 51 communicating with the right face of element 46. Hole 48 forms a fluid connection between passages 49 and 51.

The liquid passage system includes a liquid passage 52 to the left of plug element 46 and a liquid passage 53 to the right of plug element 46. Hole 50 forms a liquid connection between passages 52 and 53.

A compression spring 54 is located below plug element 46 for moving it upwardly from the closed position shown in FIG. 2. A manually-operated cam element 56 is located directly above the plug element for moving it downwardly to the FIG. 2 position. The cam element is located between two transversely-spaced arms 57 that extend upwardly from valve housing 16. Only one of arms 57 is shown in FIG. 2; the other (non-illustrated) arm appears in FIG. 1. A support shaft 59 extends through aligned holes in cam element 56 and the two arm 57 to swingably support the cam element for rocking motion around the shaft axis.

Flat paddle-like handles 60 and 61 extend from cam element 56 for manual actuation of the cam element. Manual finger pressure on the upper face of handle 60 rotates cam element 56 in a clockwise direction, such that spring 54 is enabled to push plug element 46 upwardly to the valve-open position, i.e. the position wherein holes 48 and 50 register with their respective passage systems (air and liquid). Manual finger pressure on the upper surface of handle 61 returns cam element 56 to its illustrated valve-closed position. The contour on cam surface 58 is determinative of the plug element motion.

Stop devices are incorporated into the valve mechanism to limit the motion of cam element 56 and each handle operator 60 or 61. A stop member 63 is carried on cam element 56 to engage the rear edge of an arm 57, to thus limit counterclockwise motion of cam element 56. A stop member 64 is carried on handle 60 to engage the front edge of an arm 57, thereby limiting clockwise motion of cam element 56.

The valve mechanism is designed so that a downward manual force is required on each handle operator to open or close the valve mechanism. This feature minimizes the potential for upsetting the bottle from its designated position on cradle 14. When the valve mechanism is opened liquid is discharged from bottle 12 through passages 52 and 53. Simultaneously air can pass through passages 51 and 49 into tube 41 to fill the void in the bottle left by the downflowing liquid. When the valve mechanism is closed the air supply tube is closed, such that the carbonation is sealed in bottle 12 (the soft drink remains in a carbonated state rather than going flat).

Shaft 59 is removably connected between arms 57 so that it can be manually drawn out of the aligned holes in arms 57 and cam element 56. The cam element can be removed from the space between arms 57, whereupon spring 54 will automatically shift plug element 46 upwardly to permit complete removal of the plug element from the socket in valve housing 16. Removal of these components (59, 56, 46) facilitates access to internal surfaces for cleaning (sanitation) purposes. In a similar vein, tube 41 has a releasable fit in bore 42 to facilitate cleaning of the tube and/or air passage system. The various components are formed of a rigid plastic material resistant to high temperatures commonly produced within household dishwashers.

As previously noted, plug element 46 is vertically slidable but non-rotatable. Undesired rotation of the plug element may be prevented by means of a non-circular cross-sectioned rod 66 extending within a similarly cross-sectioned bore in plug element 46. The plug element can slide, but not rotate, such that holes 48 and 50 are prevented from becoming misaligned relative to the associated passages.

The drawings show one specific form of the invention. The invention can be practiced in other forms and configurations.

What is claimed is:

1. A dispenser for a refrigerated carbonated liquid beverage, comprising a cradle adapted for positionment on the shelf of a refrigerator to removably support a beverage container in an inverted tilted condition, with the liquid discharge neck of the container located near the front edge of the refrigerator shelf below the general plane of the container bottom wall; a valve housing having an internally threaded section for screw-on attachment of the housing to the liquid discharge neck of the container; an elongated air tube having a first end thereof connected to said valve housing and a second end thereof locatable within the inverted beverage container in near proximity to the container bottom wall; a vertical axis socket formed in said valve housing; a plug valve element slidably arranged in the socket for movement in a vertical direction; an air supply passage system extending through the valve housing, said air supply passage system comprising an air passage (49) extending between said first end of the air tube and a side surface of said plug valve element; a liquid discharge passage system extending through the valve housing for conveying liquid from the container through the valve housing, said liquid discharge passage system comprising a liquid passage (52) extending between the internally threaded section of the housing and a side surface of said plug valve element; a first hole extending transversely through the plug valve element for potential communication with said air passage; a second hole extending transversely through the plug valve element for potential communication with said liquid passage; spring means located within said socket for biasing the plug valve element upwardly to a position wherein said first hole communicates with said air passage, and said second hole communicates with said liquid passage; and a manual operator means connected to said plug valve element for moving said valve element downwardly to a position wherein the transverse holes are out of fluid communication with the respective passages.

2. The dispenser of claim 1, where said manual operator means comprises two laterally-spaced arms (57) projecting upwardly from the valve housing in straddling relation to the pug valve element, and a cam element swingably arranged between said arms for pivotal motion around a fixed horizontal axis extending transversely through said arms; said cam element having a cam surface in slidable contact with an upper end surface of the plug valve element, whereby movement of the cam surface along said end surface controls the position of the valve element in the socket.

3. The dispenser of claim 2, wherein said manual operator means further includes two paddle-type handles extending in opposite directions from said cam element; said paddle-type handles being symmetrical with respect to an imaginary vertical plane coincident with the sam element pivot axis, whereby downward manual pressure on one of the handles produces a downward motion of the plug valve element, and downward manual pressure on the other handle produces an upward motion of the plug valve element.

4. The dispenser of claim 1, wherein said first transverse hole is located above said second transverse hole.

* * * * *